United States Patent [19]

Mah

[11] Patent Number: 4,607,543

[45] Date of Patent: Aug. 26, 1986

[54] DIGITAL BOTTLE OPENER

[76] Inventor: Frederick Mah, 78 LaRonde Ave., Sault Ste. Marie, Ontario, Canada

[21] Appl. No.: 718,449

[22] Filed: Apr. 1, 1985

[51] Int. Cl.[4] ..... B67B 7/44; B67B 7/16

[52] U.S. Cl. ..... 81/3.09; 81/3.55

[58] Field of Search ..... 81/3.07, 3.09, 3.4, 81/3.55, 3.57; 377/15; 235/103, 91 G

[56] References Cited

U.S. PATENT DOCUMENTS

| | | | |
|---|---|---|---|
| 2,984,131 | 5/1961 | Walsh . | |
| 3,279,054 | 10/1966 | Yawn et al. . | |
| 3,336,665 | 8/1967 | Proctor . | |
| 3,934,123 | 1/1976 | Maurer | 377/15 |

FOREIGN PATENT DOCUMENTS

| | | | |
|---|---|---|---|
| 132019 | 1/1985 | European Pat. Off. | 215/303 |
| 197704 | 4/1977 | Fed. Rep. of Germany | 377/15 |
| 1353591 | 5/1974 | United Kingdom | 81/3.09 |

*Primary Examiner*—Roscoe V. Parker

[57] ABSTRACT

A bottle opener with counter is described which is capable of removing crown or twist caps from beverage bottles and which has a digital display indicating the number of bottles opened during a certain period. It is of relatively simple construction and is hand-held, comprising a handle or body containing the counter and a head with bottle cap engaging structure. The application of leverage or torque in removal of a bottle cap causes the counter, which may be either mechanical or electronic, to be advanced.

14 Claims, 10 Drawing Figures

DIGITAL BOTTLE OPENER

BACKGROUND OF THE INVENTION

1. Field of the Invention

This invention relates to a bottle opener which has a counter to indicate the number of bottles opened during a certain period and, more specifically, to a hand-held bottle opener which is adapted to remove caps from bottles and which has a counter with a digital display.

2. Background of the Art

There are a number of situations in which it is desirable to have a count of the number of bottles opened. Individuals may wish to keep a record of the number of bottles of a beverage which they have consumed over a given time. Also, establishments which sell beverages consumed on the premises may find it useful for inventory purposes to have a count of the number of bottles opened. In either case a bottle opener which automatically records and displays such a count is useful.

There are already known bottle openers with counters to indicate the number of bottles opened. Such prior art bottle openers are relatively complicated and expensive and are too large and cumbersome to be carried about in serving drinks. In using these openers it is intended that the bottles be taken to the opener which is often quite inconvenient.

One example of such prior art bottle openers is found in U.S. Pat. No. 3,336,665, issued Aug. 22, 1967 to L. D. Proctor. This patent relates to an opener for a beverage container with a counter which has a chute to receive the caps of bottles as they fall downward after removal from the container. As a cap falls, it contacts a lever which actuates a microswitch which operates a counter.

There is also U.S. Pat. No. 2,984,131, issued May 16, 1961 to H. J. Walsh which is directed to a metered bottle opener. When a bottle cap is being removed with the opener of Walsh the force exerted moves a contact plate which in turn moves a slide integral with the plate. Linkage connected to the slide causes a counter arm to operate a counter. This is a rather complicated arrangement housed in a cabinet and clearly not intended to be carried about to open bottles.

It should be noted that the openers of Proctor and Walsh are designed to remove crown caps only. No provision has been made for the removal of screw caps.

In order to remove a crown cap from a bottle the opener includes a cap-engaging means having a portion which fits beneath the lip of the cap at one point and which at another point of the lip exerts a downward force. Then the application of a sufficient leverage deforms the cap and lifts it off the bottle. A counter for a bottle cap opener in accordance with the reference is operated by a signal or a force which is produced by the engagement of the opener with cap of the bottle. In one form of the invention the presence of a metallic cap engaged by the opener produces an electric signal which triggers the counter. In other embodiments the counter is operated mechanically by forces produced by the torque exerted when the cap is being removed. In the latter case it is advantageous to adjust the sensitivity of the counter actuating mechanism so that the counter will be triggered only when the torque exerted by the opener is sufficient to actually remove the cap. This prevents false triggering of the counter.

SUMMARY OF THE INVENTION

It is an object of the present invention to provide a bottle opener which is hand-held and which has a counter to indicate the number of bottles opened.

It is another object of the invention to provide a counting bottle opener which is small, light, portable and relatively simple.

It is a further object to provide a bottle opener which is adaptable to the removal of both crown and twist caps.

In accordance with a broad aspect of the invention there is provided a bottle opener with counter comprising:

a body;

bottle-cap engaging means integral with said body adjacent one end thereof and adapted to remove the cap from a bottle when appropriate torque is applied to said body;

counter means in said body; and counter actuating means operatively associated with said bottle-cap engaging means and operable to increase the count recorded by said counter means each time torque is applied to said body in removing a cap from a bottle.

There is also provided a bottle opener with counter comprising:

a handle;

bottle-cap engaging means;

means operatively connecting said handle to said bottle-cap engaging means and permitting relative movement of said handle with respect to said bottle-cap engaging means when said bottle-cap engaging means engages the cap of a bottle to be opened and torque is applied to said handle;

counter means positioned in said handle; and counter actuating means operable to advance the count of said counter by one each time torque is applied to said handle in removing a cap from a bottle.

BRIEF DESCRIPTION OF THE DRAWINGS

Certain embodiments of the invention will now be described which are to be read in conjunction with the accompanying drawings in which.

DESCRIPTION OF THE PREFERRED EMBODIMENTS

Figure 1:
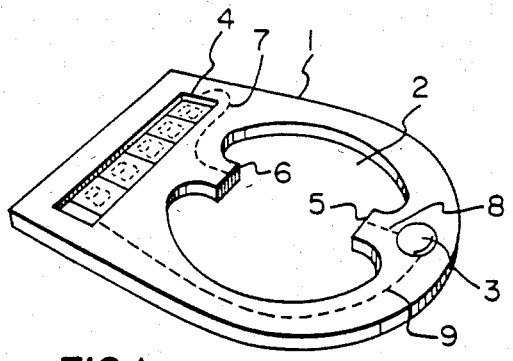
FIG. 1 is a perspective view of an embodiment of the invention.
Figure 2:
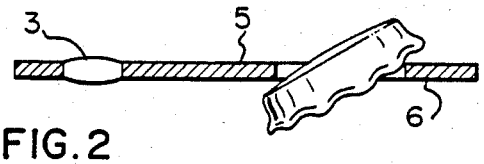
FIG. 2 is a cross-sectional view in elevation of a portion of the embodiment of FIG. 1.

There is illustrated in the embodiment of FIG. 1 a compact portable bottle opener comprising a planar body 1 of plate-like form. Integral with the body 1 is bottle-cap engaging means 2 which is defined by an aperture of appropriate dimensions to receive a crown bottle cap. The bottle-cap engaging means includes re-entrant spurs 5 and 6 which are adapted to contact opposite sides of the cap in the manner illustrated in FIG. 2 to cause removal of the cap from the bottle when sufficient upward leverage is applied to the body of the opener.

An electronic digital counter 4 and a battery 3 are located in body 1 and interconnecting electrical conductors 7, 8 and 9 are embedded therein in circuit with the counter and battery. It will be understood that, in case the body 1 is composed of metal, conductors 7, 8 and 9 must be insulated from the body. When a metallic bottle cap is engaged by the opener of FIG. 1 an electrical circuit is completed through the cap to cause the counter to be advanced by a count of one.

Figure 3A:
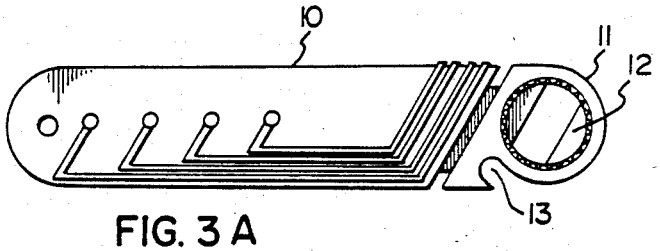
FIG. 3A is a plan view of the embodiment of the invention illustrated in FIG. 3.
Figure 3:
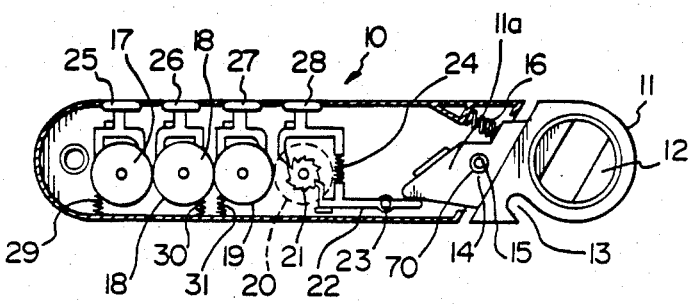
FIG. 3 is a view, partially in section, of another embodiment of the invention.

The bottle opener illustrated in FIG. 3 is of the type in which the torque exerted on the opener in removing the bottle cap produces a force which actuates a mechanical counter.

The counter of FIG. 3 includes a body 10 and a head 11. The head contains a cap-engaging means 13 for the removal of crown caps and a second cap-engaging means 12 for the removal of screw type caps.

Enclosed within the body 20 as shown in FIG. 3 is the counter which comprises a series of cascaded gears 17, 18 and 19 each of which carries on its outer circumference a sequence of digits which are visibly displayed in the handle. Gears 17, 18 and 19 are driven from another gear 20. Fast with gear 20 is ratchet wheel 21. Ratchet wheel 21 is advanced by a pawl which is integral with a lever 22 which pivots about pin 23. A rocker 14 is mounted to head 11 and is pivotally attached to body 10 by pin 15. It is spring loaded by coil spring 16. When leverage or torque is applied to the handle in removing a cap from a bottle, head 11 and rocker 14 pivots about pin 15 against the force of spring 16. At the same time block 11A depresses the right end of lever 22, which acts as a motion multiplier and which when acted on by rocker 14 causes the pawl to advance ratchet wheel 21 to increase the count of the counter. Reset buttons 25, 26 27 and 28 which act against springs 29, 30, 31 and 24 respectively serve to reset the counter to zero when a count is completed.

An added advantage of the embodiment of FIG. 3 is that a minimum deflection of head 11 with respect to body 10 is all that is necessary to advance the counter. This deflection is proportional to the force applied as spring 16 is compressed by the force exerted on it by rocker 14.

Figure 4:
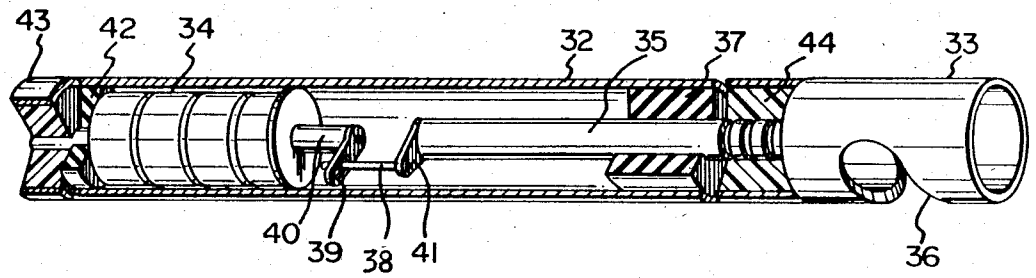
FIG. 4 is a perspective view of a further embodiemt of the invention partially broken away to show internal construction.

In the embodiment of FIG. 4 the head 33, which has a bottle cap engaging portion 36, has cast in its core by resin filling 44 a deflection beam 35. The deflection beam passes into the handle 32 through a resilient bushing 37 which may be, e.g., of hard rubber. Beam 35 has attached to it at the end remote from the head an arm 41 extending laterally of the length of the beam and a rod 38 extending from arm 41 longitudinally of the head. Counter 34 has a series of tumblers and a shaft 40 extending in the direction of the head. A counter trip arm 39 is fixed to the end of shaft 40 and contains an aperture in which the free end of rod 38 is located as clearly shown in FIG. 4.

The leverage exerted in removing a bottle cap produces relative motion between head 33 and body 32 owing to the resiliency of bushing 37. This causes the inner end of beam 35 to be deflected laterally. When this occurs rod 38 acts on counter trip arm 39 causing it to advance the count of counter 34. A rubber grommet 42 retains the rear end of shaft 40 in position in body 32. Shaft 40 has a reset knob 43 mounted thereon.

Figure 5:
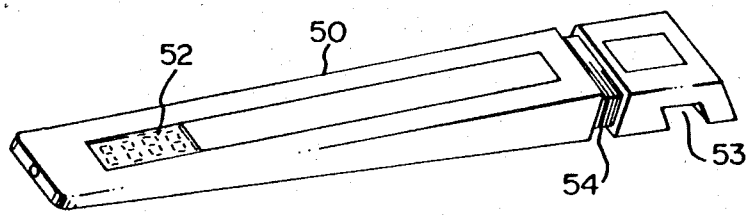
FIG. 5 is a perspective view of a still further embodiment of the invention.
Figure 6:
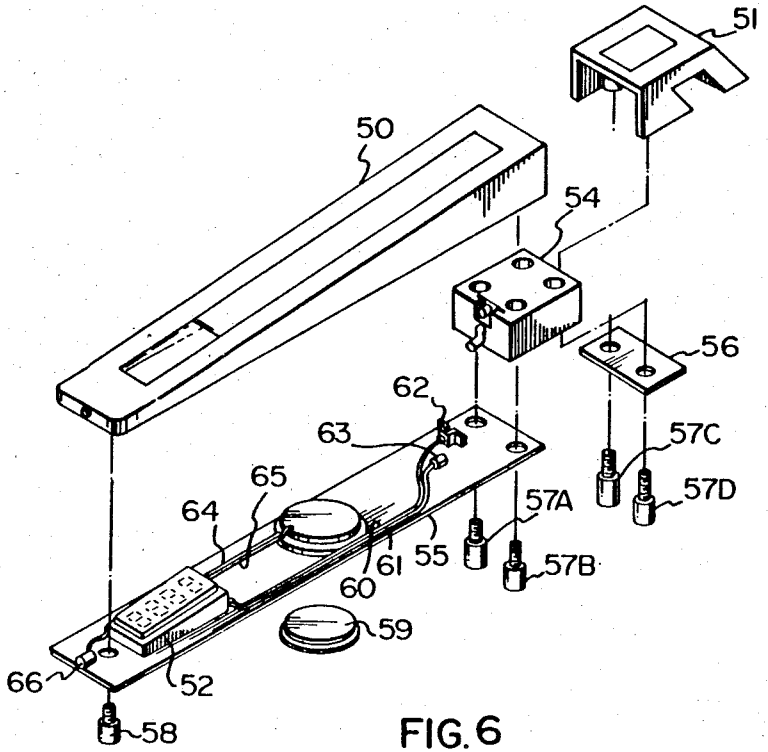
FIG. 6 is an exploded view of the embodiment of FIG. 5.

The embodiment of the invention illustrated in FIGS. 5 and 6 includes an electronic counter which gives the greatest freedom in the layout configuration. It is also adaptable to the addition of various other electronic features which could include a light, calendar, calculator, etc.

The assembly of this electronic model is shown in FIG. 6. It includes body 50, head 51, electronic counter 52, battery 59 and resilient hinge block 54. It also includes a board 55 upon which battery mount 80 and counter 52 are mounted. Shoulder screws 57A to 57D and 58 connect together body 50, head 51, hinge block 54, board 55 and plate 56.

Figure 7:
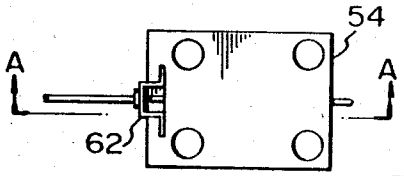
FIGS. 7, 8 and 9 are views illustrative of the hinge block of the embodiment of FIGS. 5 and 6.
Figure 8:
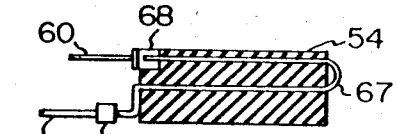
Figure 9:
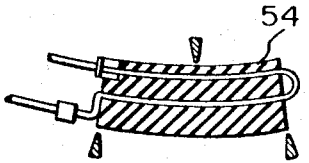

The manner of operation of the opener illustrated in FIGS. 5 and 6 will now be explained with the aid of FIGS. 7, 8 and 9. When lever action is applied to body 50 to remove a bottle cap this results in flexing of resilient hinge block 54. Embedded in hinge block 54 is an electrical conductor 67 composed of stainless steel wire or other suitable material and of generally U-shape as illustrated in FIGS. 8 and 9. Conductor 67 is electrically connected at one end to counter 52 via conductor 61 and connector 63. In the relaxed condition the other end of conductor 67 is situated very close to connector 62 which is best shown in FIG. 7 and which is electrically connected to the counter via conductor 60. Thus there is a small gap 68 between connector 62 and the adjacent end of conductor 67. The leverage exerted during the removal of a bottle cap causes sufficient flexing of hinge block 54 to cause gap 68 to close thereby providing a completed current path and advancing the count of the counter.

As will be seen from a review of the specification, the invention provides a new and useful bottle opener which works either on a mechanical or electronic principle, which uses the principle of leverage to trigger the counting mechanism. The device will be of interest for promotion of new kinds of beer or new types of bottle tops, such as the twist top. The device may be of interest to a bartender who would like to know how many bottles have been opened on his shift, or to a customer who would like to know how many bottles of beer he has consumed in a certain length of time. The same would apply, of course, to children who may wish to know how many bottles of pop they have opened over a period of time. The device would appear to constitute a valuable form of promotional device.

The foregoing description relates to exemplary embodiments only of the invention. It will be understood that various modes of applying the principle of the invention will occur to those skilled in the art. The scope of the invention is to be ascertained not from the preceding examples but rather solely from the appended claims.

I claim:

1. A bottle opener with counter comprising:

a body adapted to be hand-held by a user;

bottle-cap engaging means integral with said body adjacent one end thereof and adapted to remove the cap from a bottle when appropriate leverage is applied to said body;

counter means in said body; and counter actuating means operatively associated with said bottle-cap engaging means and operable to increase the count recorded by said counter means each time leverage is applied to said body in removing a cap from a bottle.

2. A bottle opener as claimed in claim 1 wherein said counter means comprises an electronic digital counter and wherein said counter actuating means produces electrical signals which operate said counter.

3. A bottle opener as claimed in claim 2 further comprising a battery connected in circuit with said counter actuating means and said counter.

4. A bottle opener as claimed in claim 2 wherein an electrical circuit is completed by a bottle cap when engaged by said bottle cap engaging means to remove the cap from a bottle.

5. A bottle opener with counter comprising:

a handle;

bottle-cap engaging means;

means operatively connecting said handle to said bottle-cap engaging means and permitting relative movement of said handle with respect to said bottle-cap engaging means when said bottle-cap engaging means engages the cap of a bottle to be opened and leverage is applied to said handle;

counter means positioned in said handle; and counter actuating means operable to advance the count of said counter by one each time leverage applied to said handle in removing a cap from a bottle.

6. A bottle opener as claimed in claim 5 wherein said means operatively connecting said handle to said bottle-cap engaging means comprises a rocker fixedly connected to said bottle-cap engaging means and pivotally connected to said handle.

7. A bottle opener as claimed in claim 6 wherein said counter means comprises a plurality of gears each of which carries thereon a sequence of digits and wherein the count of said counter means is advanced upon pivoting of said rocker with respect to said handle when leverage is applied to said handle to remove a cap from a bottle.

8. A bottle opener as claimed in claim 7 wherein said counter actuating means comprises a ratchet and pawl mechanism which advances the count of said counter means, said ratchet and pawl mechanism being operated by said rocker when it moves relative to said handle.

9. A bottle opener as claimed in claim 5 wherein said bottle-cap engaging means comprises a crown cap removal means and a twist cap removal means.

10. A bottle opener as claimed in claim 5 wherein said means operatively connecting said handle to said bottle-cap engaging means comprises a block of resilient material fixed in said handle and a deflection beam extending from said bottle-cap engaging means through said block, and wherein said counter actuating means comprises a counter trip arm operated by said deflection beam to advance the count of said counter means.

11. A bottle opener as claimed in claim 5 wherein said counter means comprises an electronic counter with digital display, said means operatively connecting said handle to said bottle-cap engaging means comprises a block of resilient insulating material, and said counter actuating means comprises electrical conductor means in said block having a gap therein and being connected in circuit with said counter, the arrangement being such that when a cap is being removed from a bottle the block flexes thereby closing the gap and completing an electric circuit whereby the count of the counter is advanced.

12. A bottle opener as claimed in claim 5 and further comprising counter reset means.

13. A bottle opener as claimed in claim 11 and further comprising counter reset means.

14. A bottle opener with counter comprising:

a body;

bottle-cap engaging means integral with said body adjacent one end thereof and adapted to remove the cap from a bottle when appropriate leverage is applied to said body;

counter means in said body;

counter actuating means operatively associated with said bottle-cap engaging means and operable to increase the count recorded by said counter means each time leverage is applied to said body in removing a cap from a bottle; and counter reset means.

* * * * *